US005484328A

United States Patent [19]

Osterman

[11] Patent Number: 5,484,328

[45] Date of Patent: Jan. 16, 1996

[54] SANDING TOOL

[76] Inventor: Laurence O. Osterman, 2812 Ferndale Pl., Utica, N.Y. 13501

[21] Appl. No.: 347,502

[22] Filed: Nov. 30, 1994

[51] Int. Cl.[6] ..... B24B 23/06

[52] U.S. Cl. ..... 451/356; 451/168

[58] Field of Search ..... 451/355, 356, 451/348, 162, 168, 169, 59

[56] References Cited

U.S. PATENT DOCUMENTS

| | | | |
|---|---|---|---|
| 2,493,681 | 1/1950 | Mayer et al. . | |
| 2,498,947 | 2/1950 | Fielding | 451/168 |
| 3,073,083 | 1/1963 | Reichert . | |
| 3,091,061 | 5/1963 | Bahr . | |
| 3,566,549 | 3/1971 | Britton . | |
| 4,043,083 | 8/1977 | Rosdil . | |
| 5,239,978 | 8/1993 | Plangetis | 451/358 |

*Primary Examiner*—Maurina T. Rachuba
*Attorney, Agent, or Firm*—Harris Beach & Wilcox

[57] ABSTRACT

Apparatus for working the surface of a workpiece that includes a crankshaft having a shank and two offset arms for rotation about the shank. A sanding belt is connected between the arms and is arranged to move through a reciprocal path of travel as the crankshaft is rotated in one direction. The shank is secured in the chuck of a hand-held tool such as a drill which provides motive power to the crankshaft.

8 Claims, 4 Drawing Sheets

SANDING TOOL

BACKGROUND OF THE INVENTION

This invention relates to a sanding apparatus for use in association with an electric motor that is ideally suited for sanding, polishing and finishing an arcuate shaped workpiece.

A sanding device is disclosed in U.S. Pat. No. 4,043,083 to Rosdil wherein a sanding belt is trained over a series of pulleys, all of which being mounted in a heavy metal frame. Power is furnished to the pulley system by engaging one of the pulley shafts in the chuck of a hand-held drill. The entire weight of the frame and the pulley system is suspended from the drill chuck thus placing a great deal of strain on the chuck, not to mention the arm of the operator. A similar device, is disclosed in U.S. Pat. No. 3,073,083 to Reichert wherein the pulleys are driven through means of a gear train housed in a heavy metal transmission box. Britton, in U.S. Pat. No. 3,566,549 describes a sanding system powered by a hand-held drill wherein a sanding belt is arranged to endlessly track over a triangular path of travel. A spring mechanism is provided for tensioning the belt against the pulley system. A further U.S. Pat. No. 3,091,061 to Bahr involves a sanding attachment for a drill that includes a T-shaped body that houses a bent drive shaft. The shaft is coupled to a drill chuck and an oscillator motion is transmitted to a sanding belt attached to the body. Although sanding devices have been developed for use with small motor or electric drills, for the most part, these prior art devices are complex and rather bulky making them difficult to operate. In addition, these devices are all rather heavy, and thus fatigue inducing when used for any extended period of time.

SUMMARY OF THE INVENTION

It is therefore an object of the present invention to improve devices for sanding, polishing and finishing irregular surfaces.

It is a further object of the present invention to improve sanding devices for working arcuate shaped areas on a workpiece.

It is yet a further object of the present invention to improve sanding devices for working surfaces on small diameter dowels or the like.

It is another object of the present invention to provide a very simple sanding device that can be easily attached to a hand-held motor or tool for working hard to treat surfaces.

Yet another object of the present invention is to provide a light-weight device for working arcuate surfaces that is mountable in the chuck of a hand-held drill and which, because of its light weight, can be used over a long period of time without incurring a great deal of operator fatigue.

These and other objects of the present invention are attained by a sanding device that is mountable in the chuck of a motor driven tool such as a hand-held drill. The device includes a crank shaft that is secured in the drill chuck so that it turns about the axis of rotation of the chuck. The crankshaft is provided with two offset crank arms that are preferably positioned about 180° out of phase. Rotatable elements are mounted in the arms and are, in turn, connected to either end of a sanding belt so that as the crankshaft rotates, a reciprocal motion is imparted to the belt. In practice, the belt is looped about the workpiece and drawn into contact with the work surface to abrade, smooth or polish the contacted work surface.

BRIEF DESCRIPTION OF THE DRAWINGS

For a better understanding of these and other objects of the present invention, reference will be made to the following detailed description of the invention which is to be read in association with the accompanying drawings, wherein.

FIGS. *5a–5e* are plan views showing the movement of the sanding belt as the crankshaft turns through 360° of rotation.

DESCRIPTION OF THE INVENTION

Figure 1:
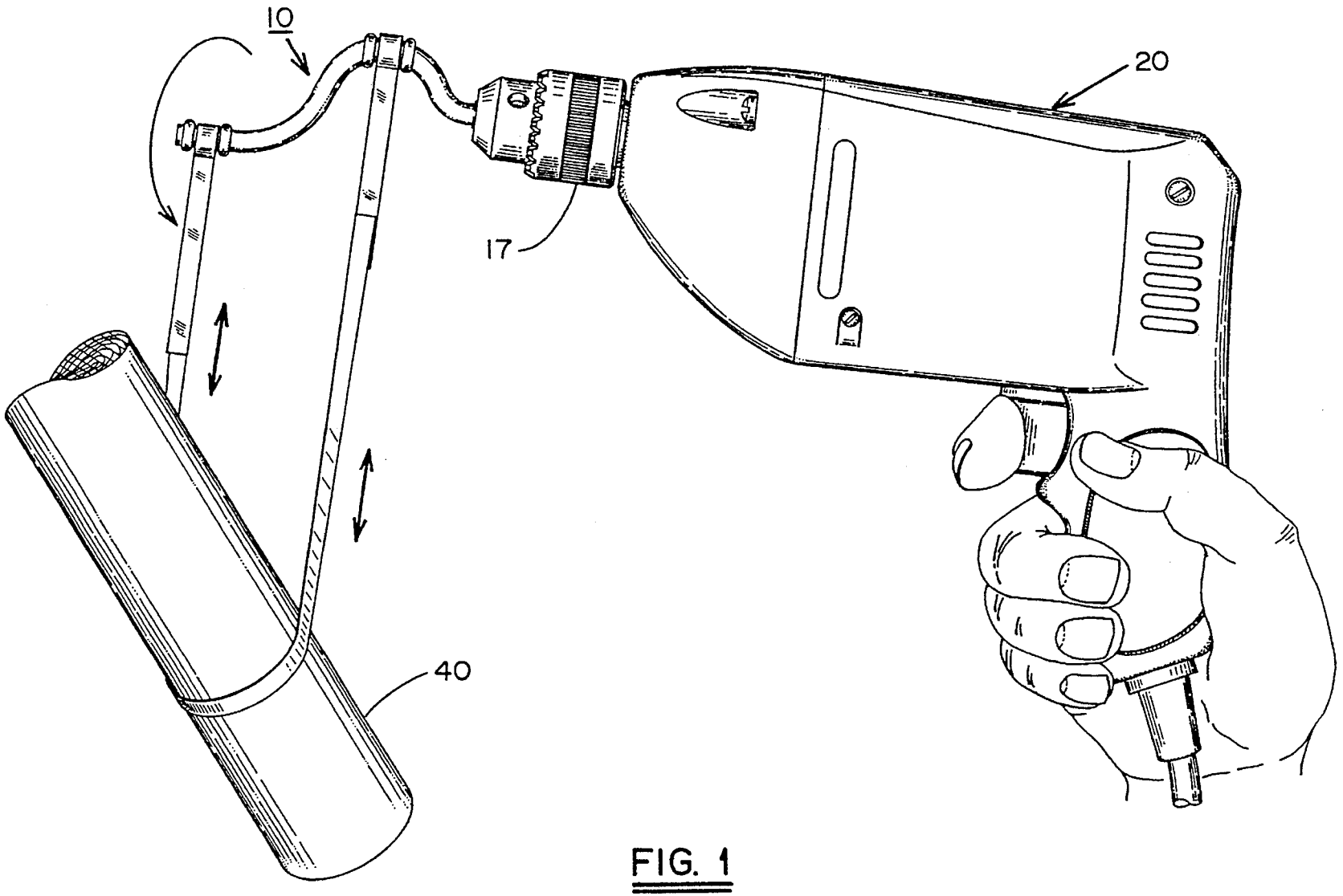
FIG. 1 is a perspective view showing the present invention mounted in the chuck of a hand-held electric drill.
Figure 4:
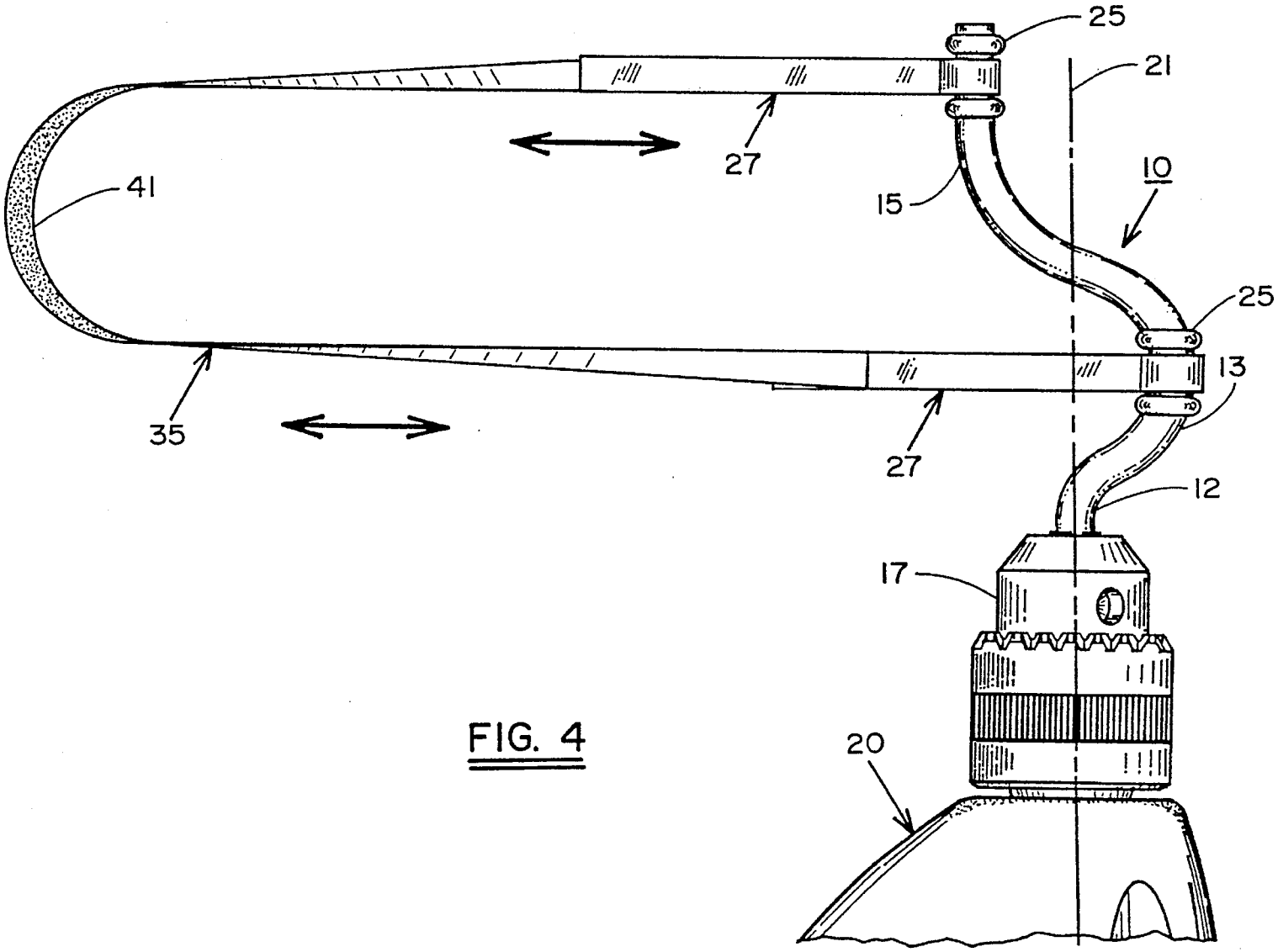
FIG. 4 is a further enlarged plan view showing the apparatus of the present invention mounted in the chuck of a power tool.

Turning now to the drawings, there is shown a crankshaft, generally referenced 10, that includes a shank 12 and a first offset arm 13 and a second offset arm 15 that are integral with the shank. As best illustrated in FIGS. 1 and 4, the shank of the crankshaft is adapted to be received in a motor driven chuck 17 or collet that preferably is part of a power tool such as a hand-held drill 20. When mounted in the chuck, the shank is arranged to turn about the axis of rotation 21 of the chuck. The shank preferably is cylindrical in cross-section but can take any suitable shape that will permit the crankshaft to be secured n the chuck and rotated as the chuck is turned by the drill motor.

Figure 2:
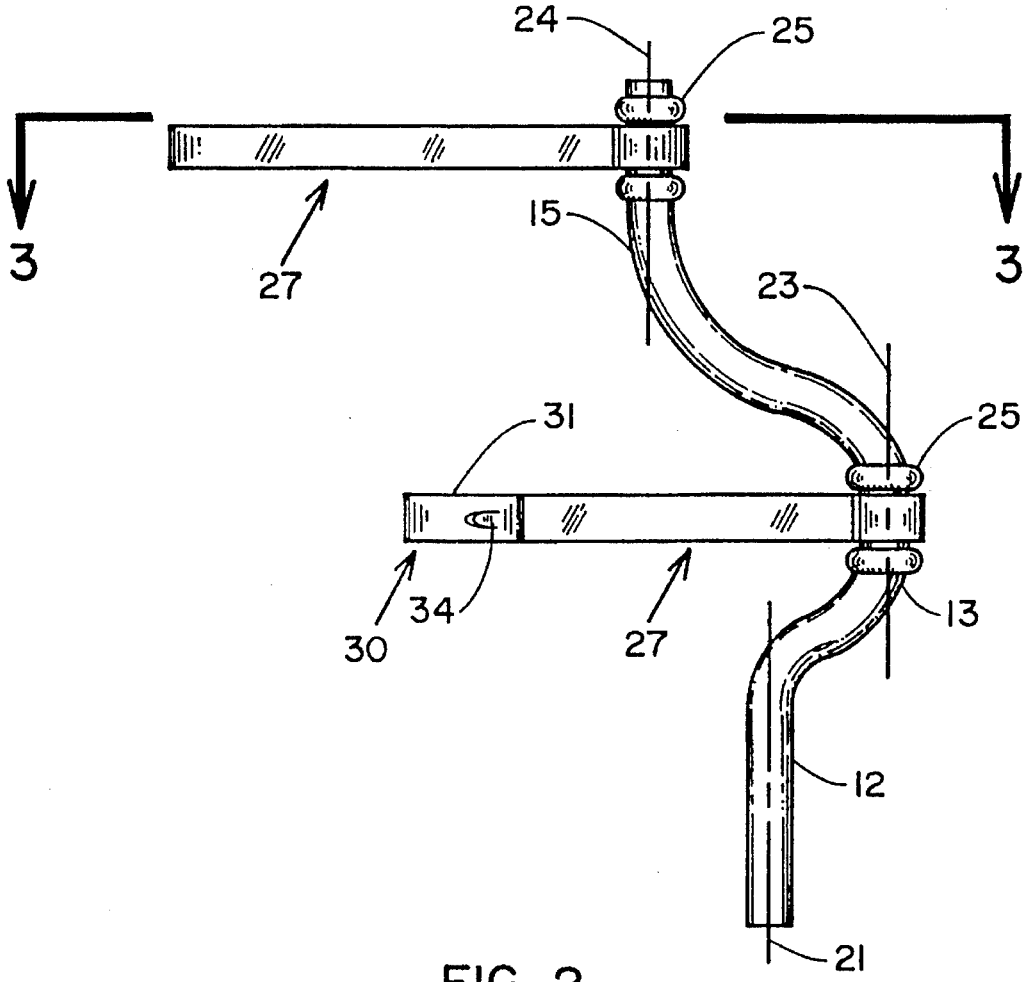
FIG. 2 is an enlarged plan view of the crank shaft of the present invention shown in FIG. 1.
Figure 3:
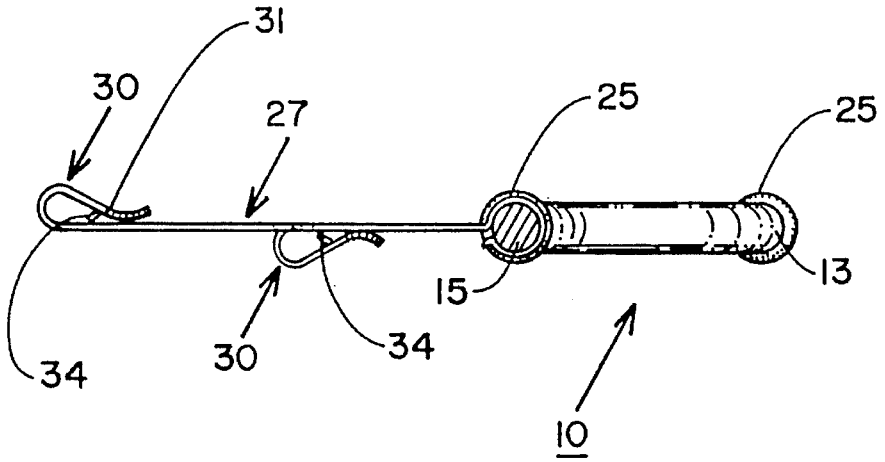
FIG. 3 is a sectional view taken along lines 3—3 in FIG. 2.

The central axes 23 and 24 (FIG. 2) of the two offset arms of the crankshaft are generally parallel with the axis of rotation of the chuck. The arms lie in a common plane that passes through the axis of rotation with arm 13 being located on one side of the shank, and arm 15 being located on the other side of the shank. The arms thus are positioned 180° apart with respect to the direction of rotation of the chuck. A rotor 25 is journaled for free rotation in each offset arm and a metal rotor strap 27 is connected to the rotor for rotation therewith. The distal end of each strap contains a connector 30 that includes a bent section that is formed into a hook like appendage 31 that is turned back into biasing contact against the body of the strap. A portion of the hook is punched inwardly to form a spike shaped tab 34 that extends downward inside the hook with the tip of the hook being located close to the body of the strap.

Each end of a sanding belt 35 is connected to the two straps to form a loop. One end of the belt is connected to the distal end of one of the metal rotor straps by simply folding over the end of the belt and inserting the folded over portion into the hook-like appendage 31 (FIG. 4) The folded over section of the belt is inserted deeply enough into the hook so that it passes under the pointed end of tab 34. The point of the tab engages the belt and prevents the belt from being pulled back from beneath the hook.

As illustrated in FIG. 1, in operation the sanding belt is placed around a workpiece, such as dowel 40, and, as will be explained in greater detail below, the circular motion of the drill is translated through the crankshaft into a reciprocal motion as depicted by the arrows. As noted above, the belt can be used for not only sanding a workpiece, but also for polishing or finish shaping an arcuate or irregular shaped workpiece. The working surface 41 of the belt can be provided with various types of abrasive materials depending upon the finishing operation that is being carried out. The present invention has been found ideally suited for working small diameter dowels.

Figures 5A, 5B, 5C, 5D, 5E:
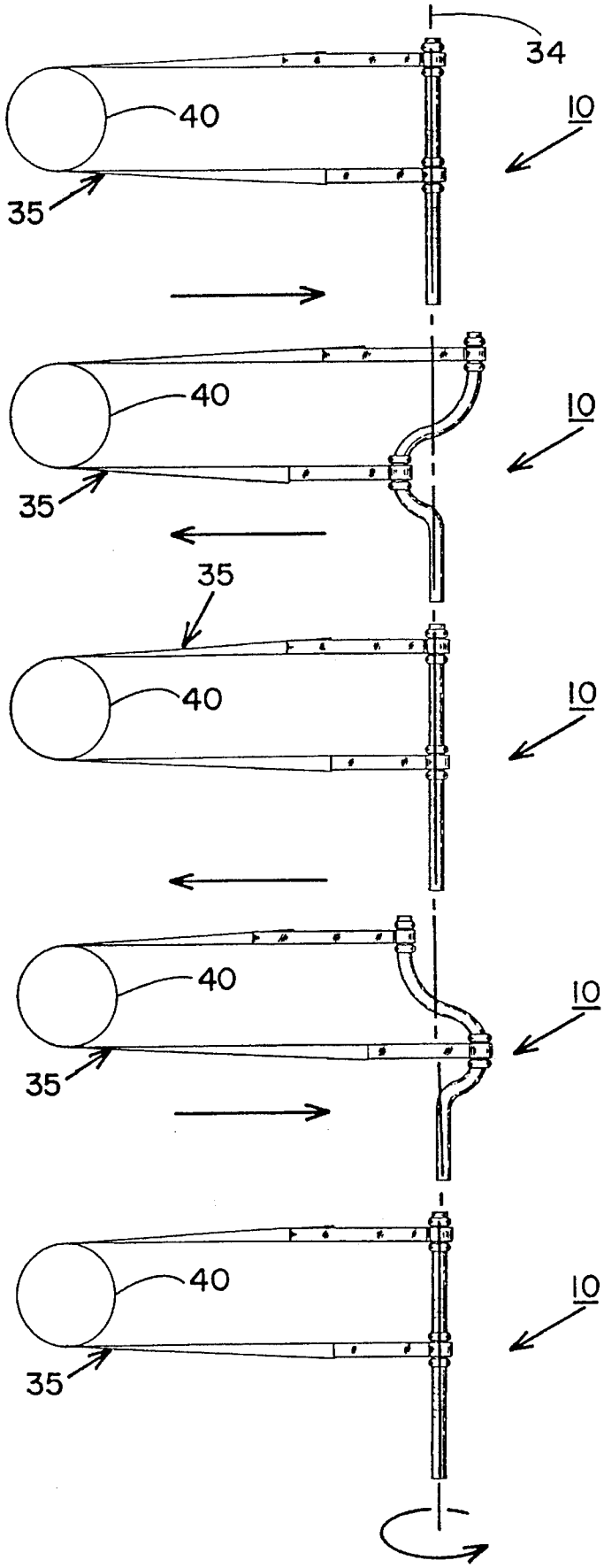

The motion of the belt 35 will be described with further reference to FIGS. 5*a*–5*e*. When the crankshaft 10 reaches a point where both of the crank arms are lying in a neutral plane 34 as illustrated in 5*a*, the reciprocal motion of the belt is momentarily at a standstill. Further rotation of the crankshaft through 90° of travel in a clockwise direction (FIG. 5*b*) causes the belt to turn about the workpiece 40 in a clockwise direction. The belt will continue to rotate clockwise until the arms are once again brought into the neutral plane as shown in FIG. 5*c*. At this time, the motion of the belt is reversed and it starts back around the workpiece in a counterclockwise direction as illustrated in FIG. 5*d*. Here again, the belt will continue to turn in a counter-clockwise direction through 180° of crankshaft rotation whereupon the arms are brought once again in the neutral plane as shown in FIG. 5*e* and the cycle is then repeated.

While this invention has been explained with reference to the structure disclosed herein, it is not confined to the details set forth and this invention is intended to cover any modifications and changes as may come within the scope of the following claims:

What is claimed is:

1. Sanding apparatus that is mountable in a motor driven chuck that includes:

a crankshaft having a shank capable of being secured in a rotatable motor driven chuck so that the shank rotates about the axis of rotation of said chuck, a first offset crank arm and a second offset crank arm attached for rotation to said shank, said arms being angularly offset from each other in regard to the direction of rotation of said crankshaft, a first rotor means connected to said first crank arm and a second rotor means connected to said second crank arm, and a flexible sanding belt connected at one end to said first rotor means and at the other end to the second rotor means whereby the belt is caused to reciprocate through an arcuate path of travel as the crankshaft turns about the axis of rotation of said chuck.

2. The apparatus of claim 1 that further includes connector means for attaching one end of the belt to each of said rotor means.

3. The apparatus of claim 2 wherein said connector means is a metal strap.

4. The apparatus of claim 3 wherein each of said metal straps contains a hook-like appendage at the distal end thereof for engaging the belt in holding contact.

5. The apparatus of claim 4 wherein said hook-like appendage further includes a locking tab for locking the belt to said strap.

6. The apparatus of claim 1 wherein said chuck is mounted upon a hand-held drill.

7. The apparatus of claim 6 wherein said shank and said arms are formed of a single piece of material.

8. The apparatus of claim 7 wherein said offset arms lie in a common plane and are spaced 180° apart with respect to the direction of rotation of the chuck.

* * * * *